US005842796A

United States Patent [19]

Horie

[11] Patent Number: 5,842,796

[45] Date of Patent: Dec. 1, 1998

[54] RIBBON CARTRIDGE HAVING GUIDE MEMBERS

[75] Inventor: Hiroaki Horie, Iwate-ken, Japan

[73] Assignee: Alps Electric Co., Ltd., Tokyo, Japan

[21] Appl. No.: 934,641

[22] Filed: Sep. 22, 1997

[30] Foreign Application Priority Data

Sep. 26, 1996 [JP] Japan ..... 8-254696

[51] Int. Cl.[6] ..... B41J 32/00; B41J 35/04

[52] U.S. Cl. ..... 400/208; 400/248

[58] Field of Search ..... 400/247, 248, 400/207, 208, 234, 242

[56] References Cited

U.S. PATENT DOCUMENTS

| | | | |
|---|---|---|---|
| 3,145,823 | 8/1964 | Spradlin | 400/242 |
| 3,323,743 | 6/1967 | Landgraf | 400/242 |
| 3,899,065 | 8/1975 | Brignole | 400/208 |
| 4,132,485 | 1/1979 | Hess | 400/234 |
| 4,402,621 | 9/1983 | Abell, Jr. et al. | 400/208 |
| 4,678,353 | 7/1987 | Richardson et al. | 400/248 |
| 4,738,554 | 4/1988 | Tajima | 400/208 |
| 4,776,714 | 10/1988 | Sugiura et al. | 400/248 |
| 4,844,636 | 7/1989 | Paque | 400/208 |
| 5,383,733 | 1/1995 | Zinsmeyer et al. | 400/208 |
| 5,501,536 | 3/1996 | Kleve | 400/208 |

FOREIGN PATENT DOCUMENTS

07251552 A 10/1995 Japan .

*Primary Examiner*—Edgar Burr
*Assistant Examiner*—Leslie Grohusky
*Attorney, Agent, or Firm*—Brinks Hofer Gilson & Lione

[57] ABSTRACT

In order to improve running stability of an ink ribbon during a recording operation and to obtain stable recording quality, a ribbon cartridge includes a ribbon guide member which is placed, at least on the side of a take-up reel of a pair of reels located inside a main case of the ribbon cartridge, between a ribbon edge in the widthwise direction orthogonal to the lengthwise direction of the ink ribbon and the inner surface of the main case and is able to be rotated when the ribbon edge contact therewith.

4 Claims, 2 Drawing Sheets

RIBBON CARTRIDGE HAVING GUIDE MEMBERS

BACKGROUND OF THE INVENTION

1. Field of the Invention

The present invention relates to a ribbon cartridge which contains an ink ribbon for use in recording a required image such as a character onto a recording medium such as paper by means of a recording head.

2. Description of the Related Art

In a general type of printer such as a thermal-transfer printer and a wire-dot printer and recording apparatus such as a facsimile and a typewriter, a ribbon cartridge is loaded on a carriage which moves along a recording medium such as paper, and ink on an ink ribbon is transferred onto the recording medium while supplying the ink ribbon between a recording head and the recording medium, thereby recording a required image such as a character.

A conventional ribbon cartridge of this type to be used in a thermal-transfer printer will be described as an example. The conventional ribbon cartridge includes a pair of rotatable reels placed inside a main case thereof, on which reels an ink ribbon is wound from both ends thereof, respectively. One of the reels serves as a take-up reel for winding the ink ribbon which has been used for recording, and the other reel serves as a delivery reel for unreeling the ink ribbon. Furthermore, the ink ribbon is guided by a plurality of guide rollers between the delivery reel and the take-up reel, and the running path thereof is thereby regulated. Still furthermore, the ink ribbon is led out of the main case between the delivery reel and the take-up reel to be submitted to recording.

The take-up reel and the delivery reel are allowed to be driven by a well-known ribbon feeding mechanism which is mounted on a carriage in the recording apparatus. In other words, the take-up reel is driven in correlation to the movement of the carriage, or driven by a predetermined take-up torque through a slip mechanism which is composed of a take-up bobbin to be driven by a motor or the like mounted on the carriage and a felt or the like, thereby applying a required tension to the ink ribbon. The delivery reel is given a required torque (back tension) through a slip mechanism composed of a delivery bobbin, a coil spring and the like which are mounted on the carriage.

According to such configuration, in a recording operation, the ink ribbon nipped between a thermal head serving as a recording head and a platen together with paper serving as a recording medium is unreeled from the delivery reel in correlation to the movement of the carriage, and substantially submitted to recording. After recording, the part of the ink ribbon which has been used for recording is separated from the paper and sequentially wound onto the take-up reel.

In the foregoing conventional ribbon cartridge, though the ink ribbon unreeled from the delivery reel is intermittently wound onto the take-up reel during the recording operation, a phenomenon called widthwise offset occurs to the ink ribbon to be wound onto the take-up reel, in which phenomenon the edges of the ink ribbon in the widthwise direction orthogonal to the lengthwise direction thereof slip in the widthwise direction and are not positioned in the same plane, and the wound roll of ink ribbon is substantially uneven. If this widthwise offset occurs, the widthwise edges of the ink ribbon slide in contact with the inner surfaces of the main case, and friction load is thereby caused. The friction load owing to the ink ribbon arises mainly on the side of the take-up reel, and varies with the change in contact area at the sliding portion depending on the pancake diameter, that is, the diameter of the ink ribbon wound on the take-up reel. This makes the feeding of the ink ribbon unstable during the recording operation, and makes it impossible to achieve always stable and appropriate recording quality.

SUMMARY OF THE INVENTION

Accordingly, it is an object of the present invention to provide a ribbon cartridge which is able to enhance running stability of an ink ribbon during a recording operation and to obtain stable recording quality.

In order to achieve the above object, there is provided a ribbon cartridge having a driven ribbon guide member placed between an edge of an ink ribbon and an inner wall of a case of the ribbon cartridge at least on the side of a take-up reel of the take-up reel and a delivery reel, whereby the running position of the widthwise edge of the ink ribbon to be wound onto the take-up reel can be appropriately regulated. Furthermore, since the ribbon guide member rotates together with the take-up reel, the rotation load of the ink ribbon to be wound is kept almost constant without causing the above-mentioned defective condition in which the widthwise edge of the ink ribbon suffers widthwise offset in winding the ink ribbon and slides in contact with the inner walls of the case of the ink ribbon.

DESCRIPTION OF THE PREFERRED EMBODIMENT

An embodiment of the present invention will be described below with reference to the drawings.

Figure 1:
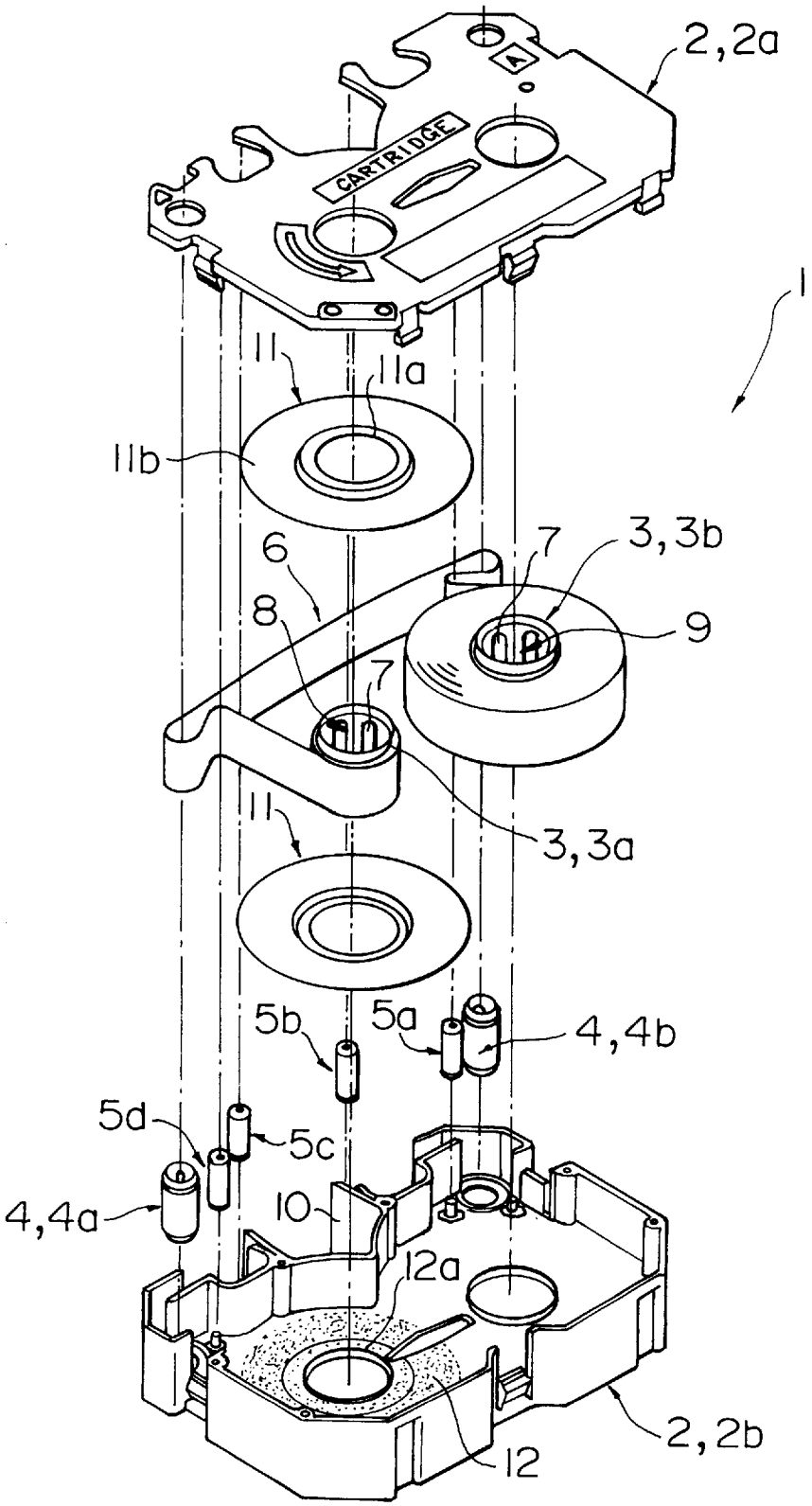
FIG. 1 is an exploded perspective view showing the overall configuration of a ribbon cartridge according to an embodiment of the present invention.
Figure 2:
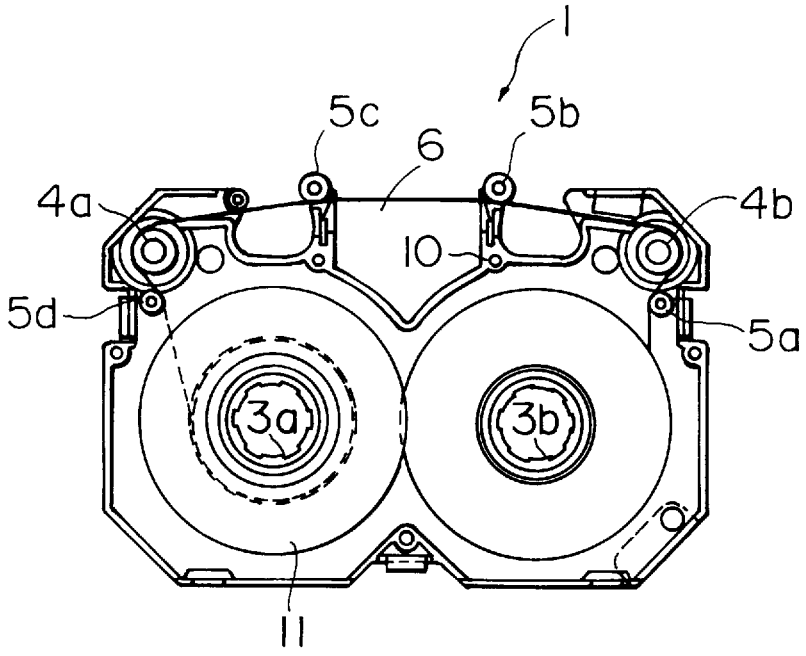
FIG. 2 is a plan view showing the internal structure of the ribbon cartridge of the invention.
Figure 3:
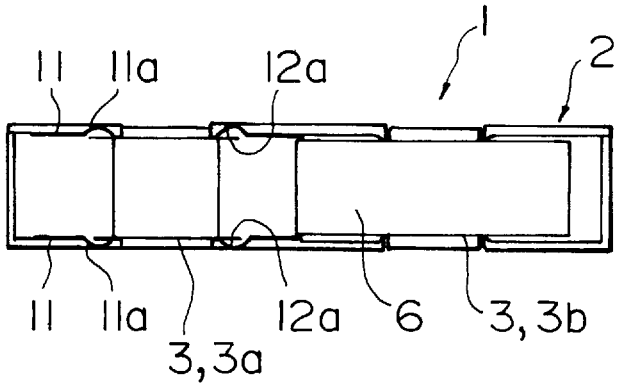
FIG. 3 is a longitudinal sectional view showing the internal structure of the ribbon cartridge of the invention.

FIGS. 1 to 3 show a ribbon cartridge according to an embodiment of the present invention. FIG. 1 is an exploded perspective view showing the overall configuration of the ribbon cartridge, FIG. 2 is a plan view showing the internal structure of the ribbon cartridge, and FIG. 3 is a longitudinal sectional view showing the internal structure of the ribbon cartridge.

As shown in FIGS. 1 to 3, a ribbon cartridge 1 of the embodiment has an almost rectangular flat main case 2 composed of a pair of upper and lower cases 2*a* and 2*b*. Inside the main case 2, there are provided a pair of rotatably supported reels 3, a pair of rotatably supported ribbon feeding rollers 4, and a plurality of guide rollers rotatably supported and facing the ribbon path, in this embodiment, four guide rollers 5*a*, 5*b*, 5*c* and 5*d* arranged in this order from the upstream side of the ribbon path.

The pair of reels 3 each have an almost cylindrical shape, both lengthwise ends of a well-known type of ink ribbon 6 are fixed on the outer peripheral surfaces of the reels 3, respectively, and the ink ribbon 6 is wound on the reels 3 from both ends thereof. When the pair of reels 3 are mounted on a known type of carriage which is not shown, one of the reels 3 placed on the left side of FIG. 1 serves as a take-up reel 3*a* for winding the ink ribbon 6 already used for recording, and the other reel on the right side of FIG. 1 serves as a delivery reel 3*b* for delivering the ink ribbon 6. Each of the reels 3*a* and 3*b* is provided with, on the inner peripheral surface, a plurality of key ways 7 spaced in the circumferential direction in a spline manner. The inner peripheral surface of the take-up reel 3*a* on the left side of the figure defines a take-up hole 8 to be engaged with a take-up bobbin serving as a component of a known ribbon feeding mechanism, not shown, and the inner peripheral surface of the delivery reel 3*b* on the right side defines a delivery hole 9 to be engaged with a delivery bobbin serving as a component of the unillustrated known ribbon feeding mechanism.

The pair of ribbon feeding rollers 4 each have an almost cylindrical shape and are mounted on the unillustrated carriage. One of the ribbon feeding rollers 4 on the left side of FIG. 1 serves as a ribbon take-up roller 4*a* for winding the ink ribbon 6 already submitted to recording, and the other right roller serves as a ribbon delivery roller 4*b* for delivering the ink ribbon 6.

The main case 2 of the ribbon cartridge 1 is provided with a recessed section 10, which an unillustrated recording head such as a thermal head faces, on the side opposed to an unillustrated and well-known platen (upper side of FIG. 2), and an intermediate section of the ink ribbon 6 is led out of the main case 2 in the recessed section 10.

Furthermore, a pair of ring-shaped flat ribbon guide members 11 are placed on the side of the take-up reel 3*a* inside the main case 2, which members are able to rotate when the edges of the rink ribbon 6 in the widthwise direction orthogonal to the lengthwise direction are brought into contact therewith. These ribbon guide members 11 are interposed between the widthwise edges of the ink ribbon 6 to be wound onto the take-up reel 3*a* and the inner surfaces of the main case 2, respectively. In this embodiment, the inner peripheral surface of each ribbon guide member 11 is fitted on the outer peripheral surface of the take-up reel 3*a* near the end thereof. The outer diameter of the ribbon guide members 11 is, in this embodiment, set a little larger than that of the roll of ink ribbon 6 completely wound onto the take-up reel 3*a*. Furthermore, the ribbon guide members 11 are each composed of two sections, a small-area ring section 11*a* positioned on the inner peripheral side and a large-area ring section 11*b* positioned on the outer peripheral side. The small-area ring section 11*a* formed to project on the inner peripheral side is able to be in contact with a recessed section 12*a* on the inner surface of the main case 2 to be opposed to a flange section of the take-up reel 3*a*, and the large-area ring section 11*b* positioned on the outer peripheral side is able to contact with the inner surface of the main case 2.

In other words, in the ribbon guide member 11 shown on the upper side of FIGS. 1 and 3, the upper surface of the small-area ring section 11a is able to contact with the recessed section 12*a* on the inner surface of the upper case 2*a*, and the large-area ring section 11*b* is able to contact with the inner surface of the upper case 2*a* itself. In the ribbon guide member 11 shown on the lower side of FIGS. 1 and 3, the lower surface of the small-area ring section 11*a* is able to contact with the recessed section 12*a* on the inner surface of the lower case 2*b*, and the large-area ring section 11*b* is able to contact with the inner surface of the lower case 2*b* itself. When the edges of the ink ribbon 6 in the widthwise direction orthogonal to the lengthwise direction are respectively brought into contact with the ribbon guide members 11, the ribbon guide members 11 are rotated together with the ink ribbon 6 and the take-up reel 3*a*.

The ribbon guide members 11 may be fixed on the take-up reel 3*a*, and additional guide members 11 may be mounted on the side of the delivery reel 3*b*.

Furthermore, only the small-area ring section 11*a* of the ribbon guide member 11 may contact with the inner surface of the main case 2.

The ribbon guide members 11 are each made of a resin sheet called an electrically conductive sheet, to which electric conductivity is given, and having a thickness of about 0.02 mm to 0.2 mm. As the electrically conductive sheet, a polyethylene sheet containing carbon, a fluororesin sheet containing carbon and the like may be used. Furthermore, an electrically conductive sheet having a low friction coefficient with respect to the main case 2 is preferable for smoothing the rotation of the ribbon guide members 11 when the widthwise edges of the ink ribbon 6 contact therewith.

In this embodiment, at least inner walls of the main case 2 opposed to the ribbon guide members 11 are each provided with a frictional resistance reducing means 12 (partially and exaggeratedly shown in FIG. 1) formed by transferring thereon convexities and concavities called grains or satin, which are formed by conducting electric discharge machining, blasting, etching or the like on a cavity of an unillustrated mold in forming the main case 2 of resin. This frictional resistance reducing means 12 may be provided on each ribbon guide member 11*a*.

As the frictional resistance reducing means 12, a sliding member having a small frictional resistance may be stuck or coated. The frictional resistance reducing means is not limited to that of the embodiment as long as the ribbon guide members 11 are in sliding contact with the inner walls of the main case 2, smoothly rotate with the ink ribbon 6 and the take-up reel 3*a* and decrease the slide resistance as the friction load between the ribbon guide members 11 and the main case 2 when the widthwise edges of the ink ribbon 6 contact the ribbon guide members 11.

In a case in which only the small-area ring sections 11*a* of the ribbon guide members 11 are allowed to contact with the inner surfaces of the main case 2, the frictional resistance reducing means 12 may be provided only on the inner surfaces opposed to the small-area ring sections 11*a*.

Next, the action of this embodiment having the above-mentioned construction will be described.

According to the ribbon cartridge 1 of this embodiment, during a recording operation, the ink ribbon 6 is advanced from the delivery reel 3*b* along the outer periphery of the ribbon delivery roller 4*b* for delivering through the guide roller 5*a* by the unillustrated ribbon feeding mechanism. Then, the ink ribbon 6 is led out of the main case 2 through the guide roller 5*b*, guided to, for example, a thermal head serving as a recording head, passes through the guide roller 5*c*, advanced along the outer periphery of the ribbon take-up roller 4*a* through the guide roller 5*c*, and wound onto the take-up reel 3*a* through the guide roller 5*d*.

In this ribbon cartridge 1 of the embodiment, when the ink ribbon 6 unreeled from the delivery reel 3*b* is wound onto the take-up reel 3*a*, since the running positions of the widthwise edges of the ink ribbon 6 are regulated by the ribbon guide members 11, the foregoing widthwise offset can be prevented. The ribbon guide members 11 for regulating the running positions of the widthwise edges of the ink ribbon 6 to be wound onto the take-up reel 3*a* can be smoothly driven together with the ink ribbon 6 and the take-up reel 3*a* when the widthwise edges of the ink ribbon 6 contact therewith.

The load change at the winding of the ink ribbon 6 decreases because the ribbon guide members 11 are rotated together with the ink ribbon 6 and the take-up reel 3*a*, and widthwise offset is prevented by the guidance of the ink ribbon 6 in the widthwise direction by means of the ribbon guide members 11. These make it possible to reliably improve running stability of the ink ribbon 6, and to thereby certainly obtain always stable and appropriate recording quality.

Since the ribbon guide member 11 formed of an electrically conductive sheet according to this embodiment can be easily formed by stamping a belt-like electrically conductive sheet, it is possible to increase productivity and to ease the economical burden.

Furthermore, according to the ribbon cartridge 1 of this embodiment, since each ribbon guide member 11 is formed of an electrically conductive sheet, static electricity which develops on the ink ribbon 6 during the recording operation can be easily removed. In order to remove static electricity on the ink ribbon 6, for example, an electrically conductive member, which communicates with the inside and outside of the main case 2 and contacts the ribbon guide members 11 inside the main case 2, is mounted in the main case 2.

Even if each ribbon guide member 11 is not composed of two sections, the small-area ring section 11*a* and the large-area ring section 11*b*, but is shaped like a merely flat plate, it can decrease the friction load as a whole and slide with an always constant contact area, which substantially causes no problems.

Still furthermore, the present invention is not limited to the above embodiment, and various changes and modifications may be made as needed.

As described above, the ribbon cartridge of the present invention has extremely excellent advantages of improving running stability of an ink ribbon during a recording operation and of reliably obtaining always stable and appropriate recording quality.

What is claimed is:

1. A ribbon cartridge comprising:

a main cartridge case having an inner surface;

a pair of reels consisting of a take-up reel and a delivery reel rotatably placed inside said main cartridge case, an ink ribbon fixed at both ends thereof between said pair of reels and wound on said delivery reel, said ink ribbon having a widthwise edge, and a ribbon guide member placed between the edge of said ink ribbon in the widthwise direction orthogonal to the lengthwise direction thereof and the inner surface of said main cartridge case at least on the side of said take-up reel inside said main cartridge case, said ribbon guide member formed separate from said take-up reel and mounted to be rotated by the ink ribbon when in contact with said widthwise edge of said ink ribbon.

2. A ribbon cartridge according to claim 1, further comprising:

frictional resistance reducing means located on at least one of opposed surfaces of said inner surface of said main cartridge case and said ribbon guide member.

3. A ribbon cartridge according to claim 1, wherein said ribbon guide member is formed of an electrically conductive material.

4. A ribbon cartridge according to claim 3, wherein said electrically conductive material is a resin sheet provided with electric conductivity.

* * * * *